US005608440A

United States Patent [19]

Takebe

[11] Patent Number: 5,608,440

[45] Date of Patent: Mar. 4, 1997

[54] THERMAL PRINTER FOR SELECTIVELY PRINTING ON ONE OR MORE SHEETS OF PAPER

[75] Inventor: Eisuke Takebe, Iwate-ken, Japan

[73] Assignee: Alps Electric Co., Ltd, Tokyo, Japan

[21] Appl. No.: 537,554

[22] Filed: Oct. 2, 1995

[30] Foreign Application Priority Data

Oct. 20, 1994 [JP] Japan ..... 6-255384
Mar. 17, 1995 [JP] Japan ..... 7-059020

[51] Int. Cl.[6] ..... B41J 2/32
[52] U.S. Cl. ..... 347/171
[58] Field of Search ..... 347/171, 194; 400/120.01

[56] References Cited

FOREIGN PATENT DOCUMENTS 3403941 8/1985 Germany ..... 347/171
59-150761 8/1984 Japan ..... 347/171
60-174669 9/1985 Japan ..... 347/171
61-120773 6/1986 Japan ..... 347/171

*Primary Examiner*—Huan H. Tran
*Attorney, Agent, or Firm*—Guy W. Shoup; Patrick T. Bever

[57] ABSTRACT

A thermal printer capable of performing multiple printing on a plurality of superposed recording paper sheets adapted for multiple printing. The thermal printer has a first printing mode for printing on heat-sensitive paper, a second printing mode for printing on plain paper by melting and transferring ink of an ink ribbon, and a third mode for multiple printing on multiple-printing sheets. Each of these printing modes is selected by a printing mode select switch. A control unit is provided which controls the traveling speed of a carriage and a unit time period for energizing a thermal head based on the selected printing mode.

12 Claims, 3 Drawing Sheets

THERMAL PRINTER FOR SELECTIVELY PRINTING ON ONE OR MORE SHEETS OF PAPER

BACKGROUND OF THE INVENTION (1) Field of the Invention

The present invention relates to a thermal printer and, more particularly, to a thermal printer arranged to perform recording on two sheets of (copying) paper superposed one on another.

(2) Description of the Related Art

Ordinary thermal printers have a construction such as that shown in FIG. 3, in which a platen 2 in the form a lengthwise flat plate is disposed substantially at a center between front and rear sides of a frame 1 so as to extend to left and right sides of the frame 1 and so that its printing surface is substantially vertical, and in which a carriage shaft 3 is disposed so as to extend parallel to the platen 2 below the front surface of the platen 2 and in the frame 1.

A flange-like guide portion 4 is formed as a front end edge of the frame 1, and a carriage 5 is held by the carriage shaft 3 and the guide portion 4 so as to be reciprocatingly movable along the shaft 3 and the guide portion 4. A motor (not shown) for driving the carriage 5 is mounted on the carriage 5, and a thermal head 6 capable of being brought close to and moved away from the platen 2 is attached to an end portion of the carriage 5 so as to face the platen 2.

A take-up bobbin 7 is provided on an upper surface of the carriage 5. An ink ribbon accommodated in an ink ribbon cassette (not shown) mounted on the carriage is wound around the take-up bobbin 7 while being guided between the platen 2 and the thermal head 6.

A paper insertion opening 8 for inserting paper sheets (not shown) into the body of the printer is formed at the rear of the platen 2. Feed rollers 9, which are rotated by a stepping motor (not shown) through a transmission mechanism to transport each paper sheet at a predetermined speed, are provided in the paper insertion opening 8. Pressure-contact rollers 10 are rotatably disposed below the feed rollers 9 and pressed against and maintained in contact with the same. Each paper sheet inserted into the nip between the feed rollers 9 and the pressure-contact rollers 10 through the paper inlet 8 is transported to a printing position by these rollers.

A printing mode select switch 12 is provided which is capable of selecting one of two printing modes: a first printing mode for printing by directly developing a color in heat-sensitive paper according to the kind of paper used, and a second printing mode for printing on plain paper by melting and transferring ink of the ink ribbon. A control unit (not shown) is also provided which controls the thermal printer according to the selection of the printing mode select switch 12.

The operation of this thermal printer will next be described.

In the thermal printer having the above-described construction, if printing paper used is heat-sensitive paper, the first printing mode is selected by the printing mode select switch 12 while the ribbon cassette is not mounted on the carriage 5. When a heat-sensitive paper sheet inserted through the paper insertion opening 8 is transported to the printing position, the thermal head 6 is pressed against the platen 2 only with the heat-sensitive paper interposed therebetween. In this state, a color is developed by selectively driving heating elements of the thermal head 6 while moving the carriage 5, thus performing printing.

If printing paper used is plain paper, the second printing mode is selected by the printing mode select switch 12. A printing paper sheet is inserted through the paper insertion opening 8 and is pinched between the feed rollers 9 and the pressure-contact rollers 10, and the feed rollers 9 are rotated to transport the printing paper in a direction perpendicular to the direction of movement of the carriage 5. When a printing start point on the printing paper reaches such a position as to face the platen 2, the rotation of the feed rollers 9 is stopped to stop transporting the printing paper. In this state, the thermal head 6 is pressed against the platen 2 at a predetermined contact pressure with the ink ribbon and the printing paper interposed therebetween, and the heating elements of the thermal head 6 are selectively driven on the basis of a printing signal while the carriage 5 is being moved. Simultaneously the take-up bobbin 7 is rotated to separate the ink ribbon from the printing paper after printing and to wind the separated ink ribbon around the bobbin 7. In this manner, desired is performed on the printing paper.

The above-described conventional thermal printer can print on heat-sensitive paper sheets or plain paper sheets fed one after another, but cannot perform multiple printing on a plurality of printing paper sheets superposed one on another. Accordingly, if a plurality of prints having the same content are required, it is necessary to repeat printing the same data for printing on a plurality of printing sheets or to perform printing in such a manner that a plurality of carriages are arranged in parallel with each other at predetermined intervals to print the same content of data on a corresponding row of the same number of printing sheets.

In the case where the same data is repeatedly printed on a plurality of printing sheets, there is a problem that a long time is taken to complete printing on the necessary number of printing sheets. In the case where a plurality of carriages are arranged in parallel with each other, there is a problem of the thermal printer being increased in its overall size.

SUMMARY OF THE INVENTION

In view of these problems of the conventional art, an object of the present invention is to provide a thermal printer capable of printing on a plurality of recording sheets at a time.

Another object of the present invention is to provide a thermal printer having a first printing mode for printing on heat-sensitive paper provided as recording paper, a second printing mode for printing on plain paper by using an ink ribbon, and a third printing mode for performing multiple copying on a plurality of superposed recording sheet, and having a control unit capable of selectively changing these printing modes.

Yet another object of the present invention is to provide a thermal printer in which a thermal head energizing time period when the third printing mode is selected is controlled so as to be longer than an energizing time period when the first or second printing mode is selected.

Still another object of the present invention is to provide a thermal printer in which control is performed so that the traveling speed of the carriage when the third printing mode is selected is reduced relative to a carriage traveling speed when the first or second printing mode is selected, and so that a thermal head energizing time period when the third printing mode is selected is also increased A further object of the present invention is to provide a thermal printer in which control is performed so that the traveling speed of the carriage when the third printing mode is selected is reduced relative to a carriage traveling speed when the first or second printing mode is selected, and so that the thermal head is energized a certain number of times to print one dot during a travel of the carriage at this speed.

Still a further object of the present invention is to provide a thermal printer in which control is performed so that, when the third printing mode is selected, the same line is repeatedly printed a certain number of times in accordance with the same data if the temperature of an atmosphere in which the printer is operated is lower than a predetermined value.

DESCRIPTION OF THE PREFERRED EMBODIMENTS

Figure 1:
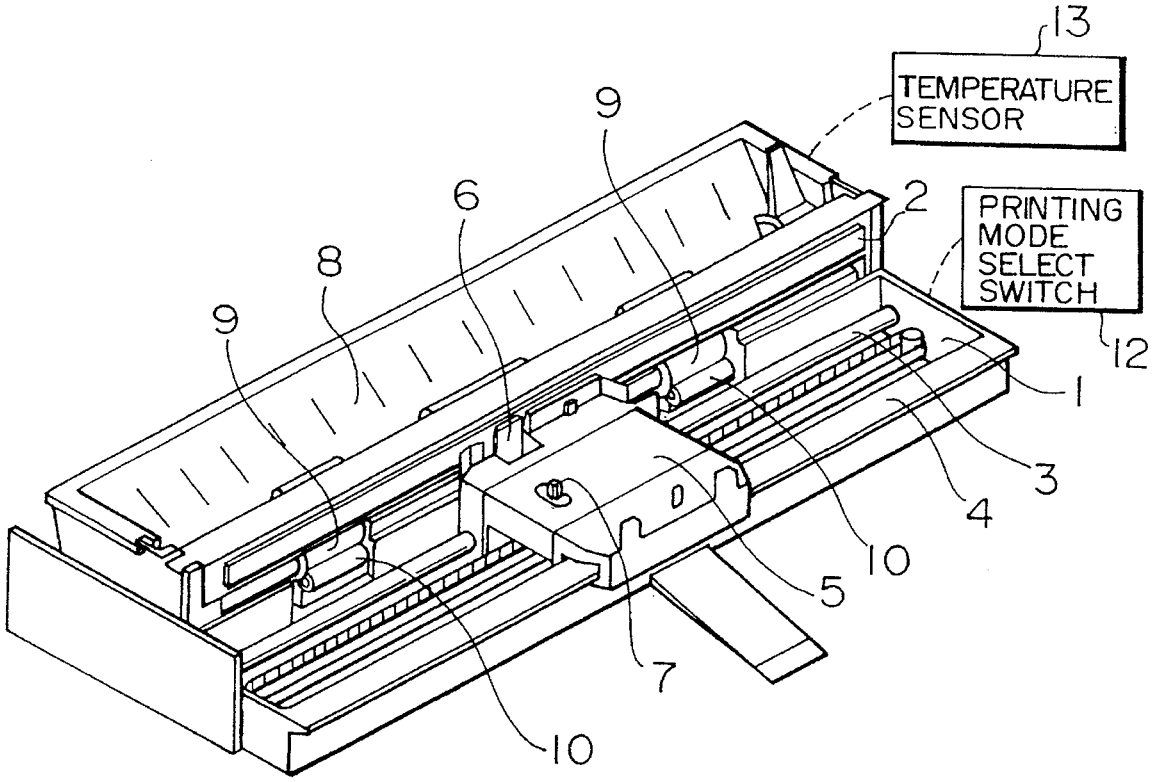
FIG. 1 is a schematic perspective view of the construction of essential portions of a thermal printer in accordance with an embodiment of the present invention.
Figure 2:
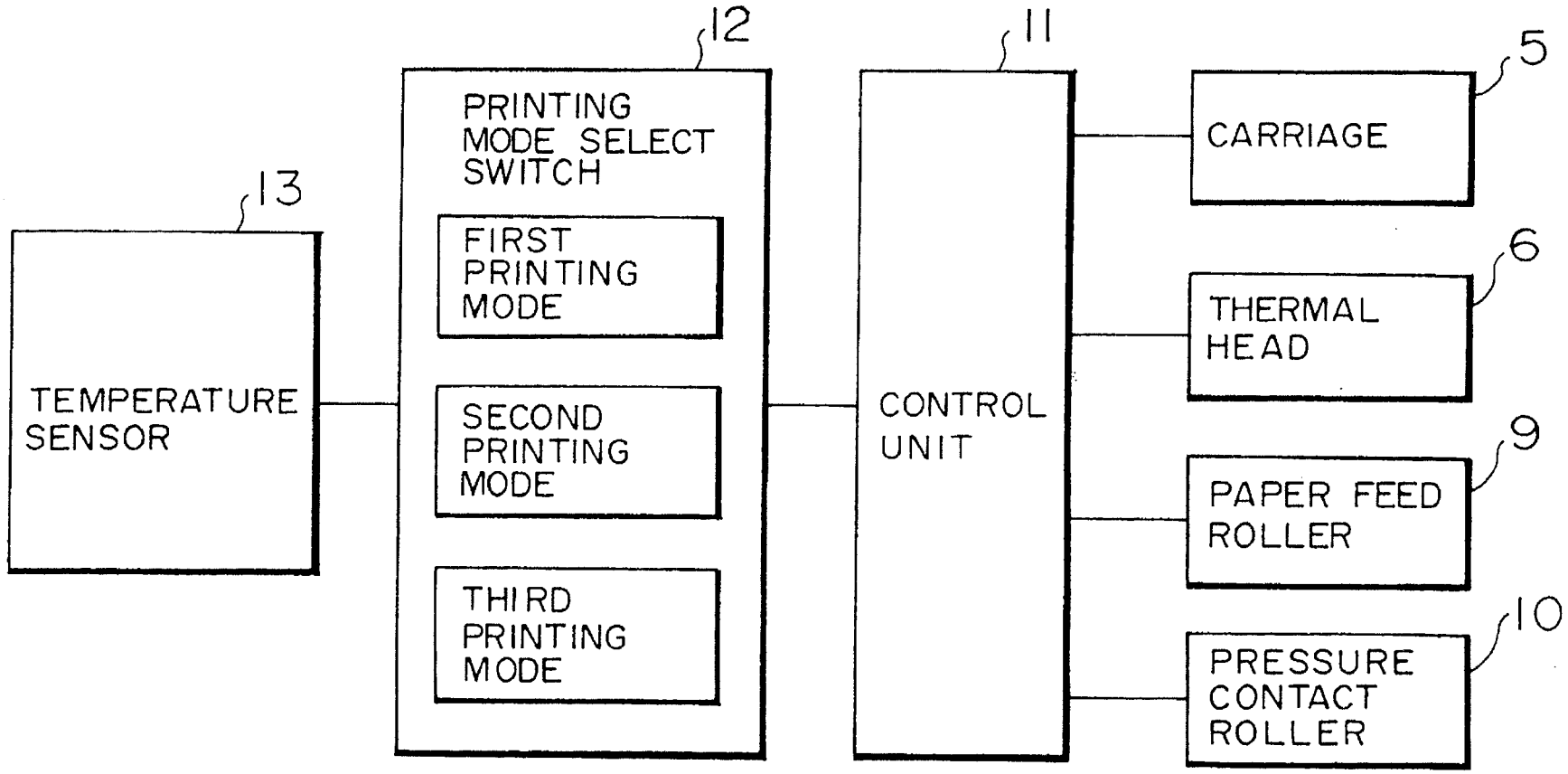
FIG. 2 is a block diagram of the thermal printer shown in FIG. 1.
Figure 3:
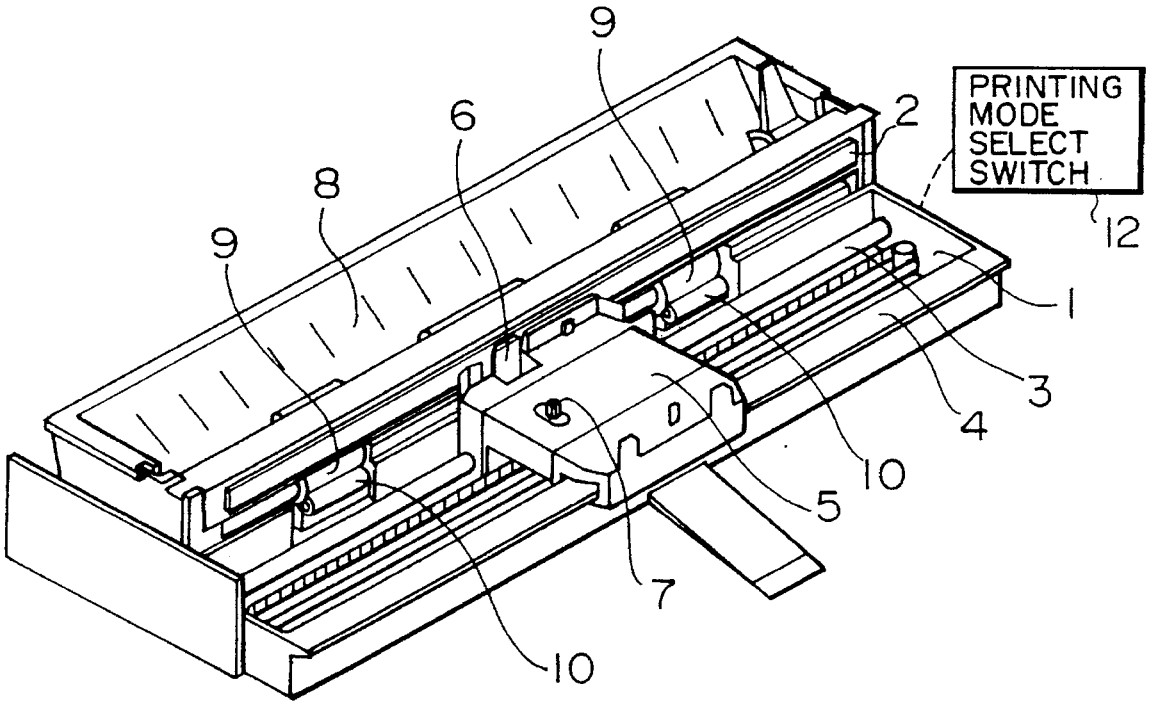
FIG. 3 PRIOR ART
FIG. 3 is a schematic perspective view of the construction of essential portions of an ordinary thermal printer.

Preferred embodiments of the present invention will be described with reference to FIGS. 1 and 2. The same components of the embodiments of the present invention as those of the conventional arrangement shown in FIG. 3 are indicated by the same reference characters and will not be described in detail.

A thermal printer which represents a first embodiment of the present invention is a thermal transfer printer in which a thermal head 6 pressed against a platen 2 with a recording paper sheet interposed therebetween is driven for printing on the recording paper sheet, and which has a control unit 11 capable of selectively changing between three printing modes according to the kind of recording paper. That is, as shown in the block diagram of FIG. 2, the control unit 11 has a first printing mode for printing on heat-sensitive paper used as recording paper, a second printing mode for printing on plain paper used as recording paper by melting and transferring ink of the ink ribbon, and a third printing mode for multiple printing on a plurality of multiple-printing paper sheets superposed one on another. When a user selects the printing mode for the desired kind of recording by a printing mode select switch 12, the control unit 11 controls the carriage 5, the thermal head 6 and other components according to the printing mode.

More specifically, when the first printing mode using heat-sensitive paper is selected, the thermal head 6 is pressed against the platen 2 with the heat-sensitive paper sheet interposed therebetween while the carriage 5 is being moved. The thermal head 6 is simultaneously driven to develop a color on a heat-sensitive paper sheet, thereby performing desired printing. When the second printing mode is selected, a ribbon cassette is mounted on the carriage 5, the carriage 5 is moved while the thermal head 6 is pressed against the platen 2 with the ink ribbon of the ribbon cassette and a plain paper sheet interposed therebetween. Simultaneously, the thermal head 6 is driven to melt and transfer ink of the ink ribbon onto the plain paper sheet, thereby performing desired printing. The control of the thermal printer in each of the first and second printing modes is the same as the above-described control of the conventional thermal printer.

Multiple printing in the third printing mode will next be described.

The third printing mode is selected when a plurality of multiple-printing paper sheets superposed one on another are used. In this embodiment, two multiple-printing sheets superposed are used. The printer is arranged for use in a plurality of cases, for example, a case where both the multiple-printing sheets are heat-sensitive paper, a case where the first sheet is a plain paper sheet while the second sheet is a heat-sensitive paper sheet, a case where the first sheet is a heat-sensitive paper sheet having a heat-meltable ink applied to its reverse surface while the second sheet is a plain paper sheet, and a case where the first sheet is a plain paper sheet having a heat-meltable ink applied to its reverse surface while the second sheet is a simple plain paper sheet.

It has been experimentally confirmed that, to achieve good printing performance even on the second one of such two multiple-printing recording sheets superposed one on another, a certain amount of thermal energy transmitted to the heat-meltable ink applied to the reverse surface of the printing sheet suffices, which is higher than a certain value such that the temperature of the heat-meltable ink becomes high enough to melt the ink. With respect to the case where the second sheet is a heat-sensitive paper sheet, it has also been confirmed that, if an amount of thermal energy exceeding a certain value is applied to the surface of the second sheet, the surface temperature of the heat-sensitive sheet becomes so high that the developed color density is sufficiently high.

Therefore, when the third printing mode is selected, in order to transmit sufficient thermal energy to the second printing sheet, a unit time period through which the thermal head 6 is energized is controlled so as to be longer than those in the first and second printing modes.

The operation of the above-described first embodiment will now be described.

First, a user selects, according to the kind of recording paper used, the printing mode by the printing mode select switch, i.e., the first printing mode in the case of heat-sensitive paper, the second printing mode in the case of plain paper, or the third printing mode in the case of superposed multiple-printing sheets. The same control as that of the conventional art is performed if the first or second printing mode is selected. A control described below is performed if the third printing mode is selected. That is, in order to transmit a sufficiently large amount of thermal energy caused by heating in the thermal head 6 to the second printing sheet, the unit time period for energizing the thermal head 6 is controlled so as to be longer than those in the first and second printing modes. The heating temperature of heating elements of the thermal head 6 is thereby increased so that the amount of thermal energy transmitted is sufficiently large. By this thermal energy, the heat-meltable ink applied to the reverse surface of the uppermost sheet is melted to be transferred to the second sheet of plain paper or a color is developed in the second sheet of heat-sensitive paper, thus performing multiple printing.

Thus, according to the first embodiment, the control unit 11 simply increases the unit time period for energizing the thermal head 6 to enable printing on a plurality of printing sheets by one printing operation. As a result, the desired printing can be performed in a short printing time without requiring a larger printer.

A second embodiment of the present invention will next be described.

As described above, multiple printing is possible if the control unit 11 performs control so that so that the unit time period for energizing the thermal head 6 is longer.

However, the upper limit of the energizing time period per dot through which the thermal head 6 can be energized is determined by the printing speed, i.e., the speed at which the carriage travels. For example, if the number of superposed recording sheets is increased in a situation where the maximum energizing time period per dot when printing is performed at 100 cps is 100 μsec, it is possible that the thermal head 6 heating temperature necessary for multiple printing cannot be reached in the energizing time period of about 100 μsec.

In the second embodiment, therefore, the printing speed, i.e., the traveling speed of the carriage, is reduced to set a sufficiently long thermal head energizing time period per dot.

For example, if the printing speed is reduced to 50 cps, the time period through which the thermal head can be energized for each dot can be increased to 200 μsec, that is, a thermal head energizing time period can be set which is twice as long as that in the above-mentioned case of printing at 100 cps. Thus, a sufficiently high thermal head 6 heating temperature can be achieved.

Consequently, in the thermal printer of the second embodiment, the speed at which the carriage 5 travels is reduced to increase the thermal head 6 energizing time period and, hence, the heating temperature of the thermal head 6, thereby enabling suitable multiple printing even if the number of superposed recording sheets is increased.

A third embodiment of the present invention will next be described.

The thermal head 6 cannot always be designed to avoid a problem described below. If the unit energizing time period is excessively long, the heating temperature of the heating elements of the thermal head 6 may become so high that the heating elements are damaged or the life of the heating elements is reduced. In the third embodiment, therefore, energizing the thermal head 6 is controlled so that the heating temperature of the thermal head 6 is lower than a certain point while the total amount of thermal energy applied to multiple printing sheets is increased.

That is, a heating temperature at which the heating elements may be damaged is previously measured and a energizing time period necessary for heating the heating elements without exceeding this limit temperature is determined. If thermal energy necessary for multiple printing on the above-described multiple printing sheets cannot be obtained in this energizing time period, printing is performed in such a manner that, while the carriage is traveling, energizing for this time period is repeated a certain number of times to accumulate applied thermal energy so that the total amount of thermal energy per dot is larger.

For example, in a case where the thermal energy necessary for multiple printing is obtained by energizing for a time period of 400 μsec while the allowable energizing time period of the thermal head 6 is 200 μsec, the heating elements are damaged and broken if the thermal head is continuously energized for 400 μsec. In such a case, therefore, the carriage traveling speed is reduced to 25 cps or lower to maintain a traveling time period of 400 μsec or more per dot. Within this time period, energizing for the allowable energizing time of 200 μsec is repeated two times to apply the necessary total amount of thermal energy corresponding to 400 μsec to the recording paper.

According to the third embodiment, as described above, the carriage traveling speed is reduced and the operation of energizing the thermal head within the allowable energizing time period is repeated a certain number of times to obtain the necessary thermal energy for multiple printing as a total amount of thermal energy. Thus, the necessary amount of thermal energy can be provided to enable multiple printing without reducing the life of the heating elements.

A fourth embodiment of the present invention will next be described.

If the thermal printer is used at a low ambient temperature, e g., 15° C. the increase in the temperature of the heat-meltable ink applied to the reverse surface of the first printing sheet is limited so that the probability of failure to perform desired printing or to obtain a sufficiently high print density on the second sheet is high. Therefore, the fourth embodiment is arranged so that a first multiple printing mode in which the operation of printing by setting the ordinary unit energizing time is repeated a certain number of times to print the same line in accordance with the same data and a second multiple printing mode in which the energizing time period per dot of the heating elements is simply increased can be selected in the above-described third printing mode.

That is, the ambient temperature is detected by a temperature sensor 13 provided in the thermal printer, and the first multiple printing mode is automatically selected if the detected temperature is lower than a set temperature, or the second multiple printing mode is automatically selected if the detected temperature is higher than the set temperature.

When the first multiple printing mode is selected, the thermal head 6 is pressed against the platen 2 with recording paper sheets interposed therebetween while the carriage 5 is being moved. Simultaneously, the thermal head 6 is driven by setting the ordinary unit energizing time. When scanning through one line is completed, the carriage 5 is returned to the original position, and the carriage 5 and the thermal head 6 are again driven to print the same line under the same condition. Since the second sheet has been heated to a certain degree by the first printing scan, the total amount of thermal energy can be increased to a sufficiently large value by the second or other scans, thereby enabling suitable multiple printing. Thus, multiple printing can be performed as desired even if the printer is used at a low temperature.

When the second multiple printing mode is selected, the thermal head 6 is energized by setting a unit energizing time period longer than the ordinary unit energizing time period to perform multiple copying, as in the above-described first embodiment.

The above-mentioned set temperature may be set by previously performing multiple copying and by being determined from the ambient temperature and the result of this multiple copying.

The printing time in the case of printing the same line a certain number of times in accordance with the same data is substantially the same as that in the case of printing on a plurality of printing sheet in a sequential manner using the same data. However, the special multiple printing mode of this embodiment is advantageous in that the need for the operations of setting printing sheets and setting printer conditions can be eliminated.

A thermal printer for printing by melting and transferring ink of an ink ribbon onto plain paper has been described with respect to the embodiments of the present invention. Needless to say, the present invention can also be applied to a direct thermal printer having a structure in which no ink ribbon can be used.

As described above, in the thermal printer of the present invention, multiple printing can be performed on a plurality of superposed copying sheets, and the printing time can be reduced without increasing the overall size of the printer.

What is claimed is:

1. A thermal printer for printing on one or more sheets of recording paper, said thermal printer comprising:

a carriage movably mounted adjacent a platen;

a thermal head mounted on the carriage and movable to press the one or more sheets of recording paper against the platen;

a control unit for controlling movement of the carriage and for energizing heating elements of the thermal head such that the thermal head produces thermal energy, the control unit including means for selecting between a first printing mode for printing on a single sheet of heat-sensitive recording paper, a second printing mode for printing on a single sheet of plain recording paper by melting and transferring ink of an ink ribbon and a third printing mode for printing on a plurality of superposed sheets of recording paper for multiple copying.

2. A thermal printer according to claim 1, wherein said control unit includes means for controlling a thermal head energizing time period per dot printed during a printing operation; and wherein, when said third printing mode is selected, said control unit energizes the thermal head in accordance with a first thermal head energizing time period per dot which is longer than a second thermal head energizing time period per dot applied to the thermal head in either of the first and second printing modes.

3. A thermal printer according to claim 2, wherein said control unit further includes means for controlling a traveling speed of the carriage along the platen; and wherein, when said third printing mode is selected, said control unit controls the carriage to travel at a first traveling speed which is lower than a second carriage traveling speed in either of the first and second printing modes.

4. A thermal printer according to claim 1, wherein said control unit further includes means for controlling a traveling speed of the carriage along the platen; and wherein, when said third printing mode is selected, said control unit controls the carriage to travel at a first traveling speed which is lower than a second carriage traveling speed in either of the first and second printing modes, and wherein said control unit controls the carriage to reciprocate such that each dot is printed by repeatedly passing the thermal head over said each dot a predetermined number of times and by energizing the thermal head during each of the predetermined number of times.

5. A thermal printer according to claim 1, wherein, when said third printing mode is selected, said control unit controls the carriage to reciprocate such that each line is repeatedly printed a predetermined number of times in accordance with selected data.

6. A thermal printer according to claim 1, further comprising:

a temperature sensor for detecting the temperature of an atmosphere in which said thermal printer is operated;

wherein, when said third mode is selected, said control unit further includes means for switching between a first multiple printing mode in which said control unit controls the carriage to reciprocate such that each line is repeatedly printed a predetermined number of times in accordance with the same data, and a second multiple printing mode in which said control unit energizes the thermal head in accordance with a thermal head energizing time period per dot which is longer than an energizing time period applied to the thermal head during the first and second printing modes; and wherein said control unit controls the thermal head in accordance with the first multiple printing mode when the temperature detected by said temperature sensor is lower than a predetermined value, and said control unit controls the thermal head in accordance with the second multiple printing mode when the temperature detected by said temperature sensor is higher than the predetermined value.

7. A thermal printer for printing on one or more sheets of recording paper, the thermal printer comprising:

a platen;

a carriage mounted to move along the platen;

a thermal head mounted on the carriage and movable to press the one or more sheets of recording paper against the platen, the thermal head including a plurality of heating elements;

a printing mode select switch; and a control unit for energizing the heating elements of the thermal head during a printing operation in accordance with a set condition of the printing mode select switch, wherein, when the printing mode select switch is set to a first printing mode for printing on a single sheet of recording paper, the control unit controls the heating elements to generate a first amount of thermal energy per dot printed during the printing operation;

wherein, when the printing mode select switch is set to a second printing mode for printing on a plurality of sheets of recording paper, the control unit controls the heating elements to generate a second amount of thermal energy per printed dot; and wherein the second amount of thermal energy is greater than the first amount of thermal energy.

8. A thermal printer according to claim 7, wherein the control unit includes means for controlling a thermal head energizing time period per dot printed during the printing operation;

wherein, when the first printing mode is selected, the control unit energizes the thermal head in accordance with a first thermal head energizing time period per dot;

wherein, when the second printing mode is selected, the control unit energizes the thermal head in accordance with a second thermal head energizing time period per dot; and wherein the second thermal head energizing time period per dot is longer than the first thermal head energizing time period per dot.

9. A thermal printer according to claim 7, wherein the control unit further includes means for controlling a traveling speed of the carriage along the platen;

wherein, when the first printing mode is selected, the control unit controls the carriage to travel at a first traveling speed;

wherein, when the second printing mode is selected, the control unit controls the carriage to travel at a second traveling speed; and wherein the second traveling speed is lower than the first traveling speed.

10. A thermal printer according to claim 7, wherein the control unit further includes means for controlling a traveling speed of the carriage along the platen; and wherein, when the third printing mode is selected, the control unit controls the carriage to travel at a first traveling speed which is lower than a second carriage traveling speed in either of the first and second printing modes, and wherein the control unit controls the carriage to reciprocate such that each dot is printed by repeatedly passing the thermal head over the each dot a predetermined number of times and by energizing the thermal head during each of the predetermined number of times.

11. A thermal printer according to claim 7, wherein, when the second printing mode is selected, the control unit controls the carriage to reciprocate such that each line is repeatedly printed a predetermined number of times in accordance with selected data.

12. A thermal printer according to claim 7, further comprising:

a temperature sensor for detecting the temperature of an atmosphere surrounding the thermal printer;

wherein the control unit further includes means for switching between a first multiple printing mode in which the control unit controls the carriage to reciprocate such that each of a plurality of printing lines is repeatedly printed a predetermined number of times, and a second multiple printing mode in which the control unit energizes the thermal head in accordance with a first thermal head energizing time period per dot which is longer than a second energizing time period applied to the thermal head during the first printing mode; and wherein the control unit controls the thermal head in accordance with the first multiple printing mode when the temperature detected by the temperature sensor is lower than a predetermined value, and the control unit controls the thermal head in accordance with the second multiple printing mode when the temperature detected by the temperature sensor is higher than the predetermined value.

* * * * *